US006699036B2

(12) United States Patent
Schlosser et al.

(10) Patent No.: US 6,699,036 B2
(45) Date of Patent: Mar. 2, 2004

(54) CURVILINEAR BURNER TUBE

(75) Inventors: Erich J. Schlosser, Barrington, IL (US); Adrian A. Bruno, Rolling Meadows, IL (US); Mohammed Shoeb, Hoffman Estates, IL (US)

(73) Assignee: Weber-Stephen Products Company, Palatine, IL (US)

( * ) Notice: Subject to any disclaimer, the term of this patent is extended or adjusted under 35 U.S.C. 154(b) by 0 days.

(21) Appl. No.: 10/141,690

(22) Filed: May 6, 2002

(65) Prior Publication Data

US 2003/0205223 A1 Nov. 6, 2003

(51) Int. Cl.[7] ..... F24C 3/08; F23D 14/62

(52) U.S. Cl. ..... 431/354; 126/41 R; 126/39 R

(58) Field of Search ..... 431/354; 126/41 R, 126/39 R; 239/553, 566, 565

(56) References Cited

U.S. PATENT DOCUMENTS

| | | | | |
|---|---|---|---|---|
| 854,491 A | * | 5/1907 | Haggerty et al. | 126/39 E |
| 1,151,188 A | * | 8/1915 | Kelly | 126/39 R |
| 1,224,157 A | | 5/1917 | Fry | |
| 2,488,388 A | * | 11/1949 | Evans | 236/15 A |
| 3,802,413 A | | 4/1974 | Pepin | |
| 3,871,355 A | | 3/1975 | Henry | |
| 4,089,258 A | | 5/1978 | Berger | |
| 4,126,117 A | | 11/1978 | Hastings | |
| 4,237,858 A | | 12/1980 | Goodnight et al. | |
| 4,267,816 A | | 5/1981 | Koziol | |
| 4,315,729 A | | 2/1982 | Tanaka et al. | |
| 4,323,017 A | | 4/1982 | Harris | |
| 4,373,505 A | | 2/1983 | Koziol | |
| 4,462,384 A | | 7/1984 | Hitch | |
| 4,478,205 A | | 10/1984 | Koziol | |
| RE31,738 E | | 11/1984 | Hastings | |
| 4,485,799 A | | 12/1984 | Perez | |
| 4,485,972 A | | 12/1984 | Freber | |
| 4,488,534 A | | 12/1984 | Koziol | |
| 4,561,419 A | | 12/1985 | Koziol | |
| 4,569,329 A | | 2/1986 | Cherryholmes | |
| RE32,133 E | | 5/1986 | Koziol | |
| 4,587,948 A | | 5/1986 | Haglund | |
| 4,598,692 A | | 7/1986 | Hitch | |
| 4,624,241 A | | 11/1986 | Cherryholmes | |
| 4,679,544 A | | 7/1987 | Koziol | |

(List continued on next page.)

FOREIGN PATENT DOCUMENTS

GB 2 075 175 * 11/1981

OTHER PUBLICATIONS

Advertising brochure for Solaire InfraVection Grills, Rasmussen Iron Works, Inc., form SOL–IV902, un–dated.

*Primary Examiner*—Alfred Basichas
(74) *Attorney, Agent, or Firm*—Wallenstein, Wagner, & Rockey, Ltd.

(57) ABSTRACT

The present invention provides a burner tube. The burner tube has a proximal segment, a distal segment, a terminal end, and a plurality of fuel outlet ports. The proximal segment has a union region and is adapted to be connected to a fuel source. The terminal end of the burner tube is connected to the union region such that the terminal end is in fluid communication with the union region. The connection between the terminal end and union region forms a continuous burner tube, or a burner loop for the flow of fuel. An initial flow of fuel diverges in the union region into a first portion and a second portion. The first portion flows through the union region and downstream through the distal segment. The second portion of fuel from the fuel source flows through the union region and downstream through the terminal end.

20 Claims, 7 Drawing Sheets

U.S. PATENT DOCUMENTS

| | | | |
|---|---|---|---|
| 4,686,957 | A | 8/1987 | Koziol |
| 4,720,257 | A | 1/1988 | Beckham et al. |
| 4,762,530 | A | 8/1988 | Koziol |
| 4,773,384 | A | 9/1988 | Koziol |
| 4,829,978 | A | 5/1989 | Schlosser |
| 4,953,358 | A | 9/1990 | Grohmann |
| 4,989,579 | A | 2/1991 | Murphy et al. |
| 5,076,256 | A | 12/1991 | Raymer et al. |
| 5,076,257 | A | 12/1991 | Raymer et al. |
| 5,103,545 | A | 4/1992 | Riehl |
| 5,127,824 | A | 7/1992 | Barker |
| 5,129,312 | A | 7/1992 | Berger |
| 5,291,875 | A | 3/1994 | Koziol |
| 5,370,527 | A | 12/1994 | Hefling et al. |
| 5,417,565 | A | 5/1995 | Long |
| 5,421,319 | A | 6/1995 | Moore, Jr. et al. |
| 5,516,282 | A | 5/1996 | Somerville |
| 5,603,256 | A | 2/1997 | Charlson et al. |
| 5,617,778 | A | 4/1997 | Schroeter et al. |
| 5,711,663 | A | 1/1998 | Giebel et al. |
| 5,755,154 | A | 5/1998 | Schroeter et al. |
| 5,778,871 | A | 7/1998 | Herring |
| 5,782,230 | A | 7/1998 | Linnebur et al. |
| 5,803,727 | A | 9/1998 | Long |
| 5,873,355 | A | 2/1999 | Schlosser et al. |
| 6,003,506 | A | 12/1999 | Long et al. |
| 6,024,083 | A | 2/2000 | Smirnov |
| 6,038,965 | A | 3/2000 | Thorndyke |
| 6,071,571 | A | 6/2000 | Lerch et al. |
| 6,102,029 | A | 8/2000 | Stephen et al. |
| 6,283,114 | B1 | 9/2001 | Giebel et al. |

* cited by examiner

CURVILINEAR BURNER TUBE

CROSS-REFERENCE TO RELATED APPLICATIONS

Not Applicable.

FEDERALLY SPONSORED RESEARCH OR DEVELOPMENT

Not Applicable.

TECHNICAL FIELD

The present invention relates to a burner tube for use with a cooking chamber. More specifically, the present invention relates to an elongated curvilinear burner tube having a union region that forms a continuous, multi-directional passageway for the flow of fuel.

BACKGROUND OF THE INVENTION

The popularity of gas barbecue grills and gas outdoor cooking devices has increased tremendously over the last twenty-five years. In contrast to charcoal barbecue grills, gas barbecue grills employ a burner assembly that requires a combustible fluid, for example, propane or natural gas, as a fuel source. Barbecue grills with gas burner elements have proven extremely popular with consumers because they provide controlled, uniform heat distribution. In addition, gas burner assemblies are relatively simple to operate and generally require less maintenance and clean-up time.

Conventional gas burner assemblies typically include a plurality of linear burner tubes, control valves, and a manifold. Each burner tube has a first end and a second end, and a plurality of fuel outlet ports spaced between the first and second ends. The first end of the burner tube is connected to a control valve which meters the flow of fuel. The first end and the control valve are connected to the manifold which is linked to a fuel source, for example, a propane tank. Therefore, multiple burner tubes extend from the manifold. The second end of the burner tube is closed or crimped such that fuel cannot flow past the second end. Accordingly, fuel from the fuel source flows in only one linear path, from the first end to the second end of the burner tube.

Conventional burner assemblies require specific construction and assembly that are susceptible to higher cost and related limitations. First, due to the fact multiple burner tubes are required to form a burner assembly, the material, labor, and assembly costs are significant. These costs are compounded by the fact that each burner tube may require a separate inlet assembly, including a venturi element and a control valve. Further, because the second end of burner tubes are closed or crimped, the first end of each burner tube must be connected to a manifold, thereby limiting the configuration of the burner assembly. Consequently, the versatility of conventional burner assemblies is reduced because such assemblies cannot be uniquely configured or utilized in a wide variety of cooking chambers.

An example of a burner assembly susceptible to the limitations identified above is U.S. Pat. No. 5,676,048 to Schroeter et al. As shown in FIGS. 2 and 11 therein, a burner assembly 17 is formed from the combination of a linear burner tube 18 and two "L-shaped" burner tubes 24. The linear burner tube 18 has a first end 19 and a closed or crimped second end 20. Referring to FIG. 12, the L-shaped burner tube 24 has a primary member 25, a secondary member 28, and a curved elbow segment 31. The first end 26 of the L-shaped burner tube 24 is open, while the second end 30 is closed. Consequently, in either burner tube 18, 24, fuel is constrained to flow in a single path—from the first end to the closed second end.

Another example of a burner assembly with the concerns identified above is U.S. Pat. No. 5,890,482 to Farnsworth et al. As shown in FIG. 2, the burner assembly is formed from the combination of six (6) burner tubes 14. Each burner tube has a venturi element, an inlet valve assembly, a first series of outlet ports, and a second series of outlet ports. Referring to FIG. 3, the burner tube 14 has a first segment 44, a second segment 42, and a curved elbow segment 46. The first segment 44 is open while the second segment 42 has a closed end. Accordingly, in the burner tubes 14, fuel flows from the first end to the closed second end.

Yet another example of a burner assembly of the prior art construction is U.S. Pat. No. 6,102,029 to Schlosser et al., which is assigned to the Assignee of the present invention. As shown in FIGS. 3–5, the burner assembly 10 generally comprises a first burner tube 21, a second burner tube 22, a third burner 23, and a crossover tube 24. The second burner tube 22 is positioned between the first and second burner tubes 21, 23 to form a burner grid 20. Each burner tube 21, 22, 23 has a first end with a venturi assembly 32 connected to a control valve 30 of the manifold 16. The second end 25 of the first, second, and third burner tubes 21, 22, 23 is closed. A crossover tube 24 ports with an orifice 28 located upstream of the second end 25 in the first and second burner tubes 21, 22. The crossover tube 24 is in fluid communication with only the first burner tube 21 and the third burner tube 23. Accordingly, the crossover tube 24 serves as a pilot tube for either the first or third burner tube 21, 23. The closed, second end 25 of the second burner tube 22 has a flange 40 that is adapted to be received by a stock connection 42 attached to the crossover tube 24. Since the second burner tube 22 is not in fluid communication with the crossover tube 24, the second burner tube 22 only receives fuel from the manifold 16. Therefore, in the second burner tube 22, fuel can only flow from the first end to the second end.

Therefore, there is a need for a continuous burner assembly formed from a burner tube wherein fuel can flow in multiple paths or directions throughout the burner tube. Also, there is a definite need for a continuous burner assembly which is compact and capable of being employed in a wide variety of cooking chambers. In addition, there is considerable need for a continuous burner assembly with a single inlet valve assembly to minimize the overall size of the burner assembly while providing an enlarged burner flame area.

The present invention is provided to solve these and other deficiencies.

SUMMARY OF THE INVENTION

The present invention relates to a burner for use with a cooking chamber. More specifically, the present invention relates to a continuous burner constructed from an elongated burner tube having a proximal segment, a distal segment, and a terminal end in fluid connection with a union region of the proximal segment. Due to the fluid connection between the terminal end and the union region, the burner has a curvilinear configuration and defines a multi-directional passageway for the flow of fuel throughout the burner.

The proximal segment is adapted to be connected to a fuel source, i.e., a fuel tank. The distal segment is downstream of the proximal segment. The terminal end is connected to the burner tube at a union or interference region of the proximal segment. The connection between the terminal end and the union region forms a continuous burner tube with a multi-directional passageway. This means that fuel from the fuel source can flow throughout the burner tube, including the proximal segment, the distal segment, the union region, and the terminal end. Specifically, fuel can flow from the proximal segment through the union region and into and through the terminal end. The burner tube has a plurality of fuel outlet ports or apertures from which flames extend. An ignitor is used to ignite fuel that has exited the outlet ports along the burner tube to form a burner flame area.

The burner tube can have a variety of configurations, including a generally obround or rectangular configuration. Preferably, the distal segment has at least one curvilinear portion, which facilitates the connection of the terminal end with the union region. Due to the mating of the terminal end with the proximal segment, the burner tube defines an enclosed central region. The terminal end is connected to the union region whereby the continuous, integral burner tube is formed. The connection between the terminal end and the union region is facilitated by the curvilinear portion. The terminal end can have a necked portion with a tapered diameter, and a mating portion. The mating portion is either partially or entirely received by an aperture in the union region. Once received by the aperture, the terminal end is in fluid communication with the union region of the proximal segment. The fluid communication between the union region and the mating portion defines a passageway or control volume for fuel to flow throughout the burner tube.

In accord with the invention, the burner tube is in a first position P1 wherein the terminal end is connected to the union region. Due to the curvilinear configuration of the distal segment, the terminal end is biased towards the union region. This biasing causes the terminal end to be lockingly engaged to, or secured with the union region in the first position P1. In a second position P2, the terminal end is unconnected or disengaged from the union region and due to the biasing described above, a portion of the terminal end extends past the union region. Also, in the second position P2, the terminal end is vertically misaligned with a plane defined by the burner tube. The second position P2 generally represents an unassembled status of the burner tube. Once aligned with the aperture, the biasing of the burner tube will cause the terminal end to lockingly engage the union region.

In the first position P1, fuel flows from the fuel source in an initial flow path through the proximal segment and into the union region. Flow separation occurs generally within the union region. A first flow path F1 flows past the union region and downstream to the distal region. Because the terminal end is in fluid communication with the union region, a second flow path F2 flows past the union region and downstream into the terminal end. Therefore, fuel from the fuel source can flow in one of two distinct paths, downstream into the distal region or downstream into the terminal end.

In further accord with the invention, the terminal end has a mating portion that is in fluid communication with the aperture of the union region. The mating portion can be received by the aperture. Structure of the mating portion can extend past the aperture such that an edge or wall of the mating portion extends into the union region. This results in alteration of the fuel flow in the union region. As a result, a first portion of fuel flows through the union region and downstream into the distal region and a second portion of fuel flows through the union region and downstream into the terminal end. The geometry of the mating portion and the degree or amount that the mating portion extends past the aperture affects the flow of the fuel in the burner tube.

Other features and advantages of the invention will be apparent from the following specification taken in conjunction with the following drawings.

DETAILED DESCRIPTION OF THE INVENTION

Figure 1:
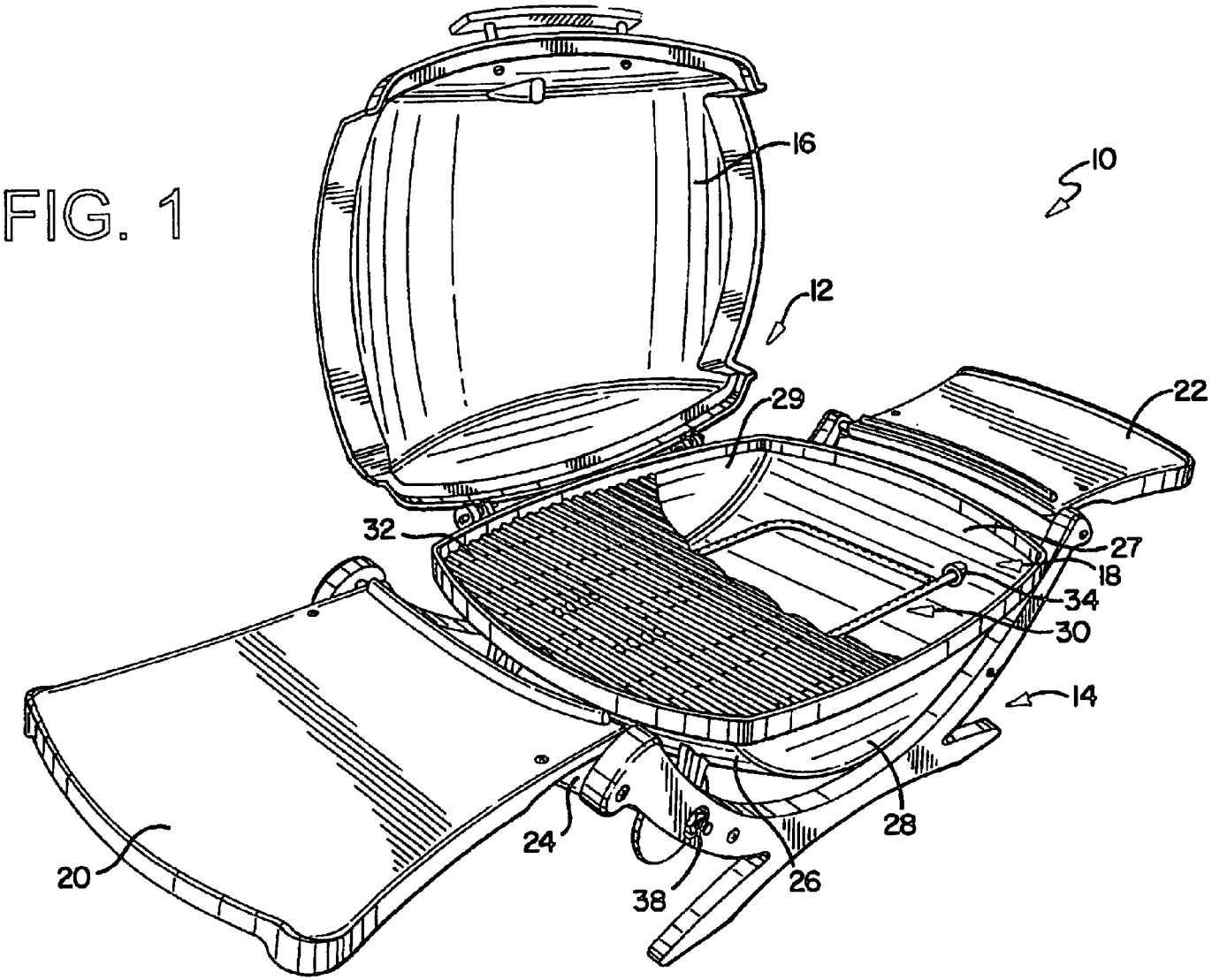
FIG. 1 is a perspective view of a barbecue grill assembly showing a first burner tube of the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A barbecue grill assembly 10 is shown in FIG. 1. The barbecue grill assembly 10 generally includes a cooking chamber 12 and a support frame assembly 14. The frame assembly 14 is adapted to provide support to the cooking chamber 12. The cooking chamber 12 includes a cover 16 hingeably connected to a firebox 18. The barbecue grill assembly 10 further includes a first work surface 20 and a second work surface 22, each operably connected to a transverse member 24 of the support frame assembly 14. The firebox 18 has an interior geometry or configuration defined by a first wall 126, a second wall 27, a front wall 28, and a rear wall 29. As shown in FIG. 1, the first and second walls 26, 27 are sloped or curved.

An elongated burner tube 30 is positioned generally within the firebox 18 of the cooking chamber 12. The burner tube 30 has a multi-directional configuration which results in passageways for the flow of fuel throughout the burner tube 30. The burner tube 30 has a geometry similar to the interior geometry of the firebox 18 whereby the burner tube 30 is received by the firebox 18. Because the burner tube 30 can be configured to match the configuration of the firebox 18, the utility and versatility of the burner tube 30 is increased. Preferably, the burner tube 30 is a cylindrical element with a circular cross-section with an inner wall diameter and an outer wall diameter. The burner tube 30 is connected to a fuel source (not shown) to define a pathway for flow of the fuel. The burner tube 30 is positioned generally between a grid or grate 32 and a bottom wall (not shown) of the firebox 18. A portion of the burner tube 30 extends through a port or opening 34 in the proximal sidewall 26 of the firebox 18. An ignitor 38 is used to ignite fuel as it flows through the burner tube 30.

Figure 2:
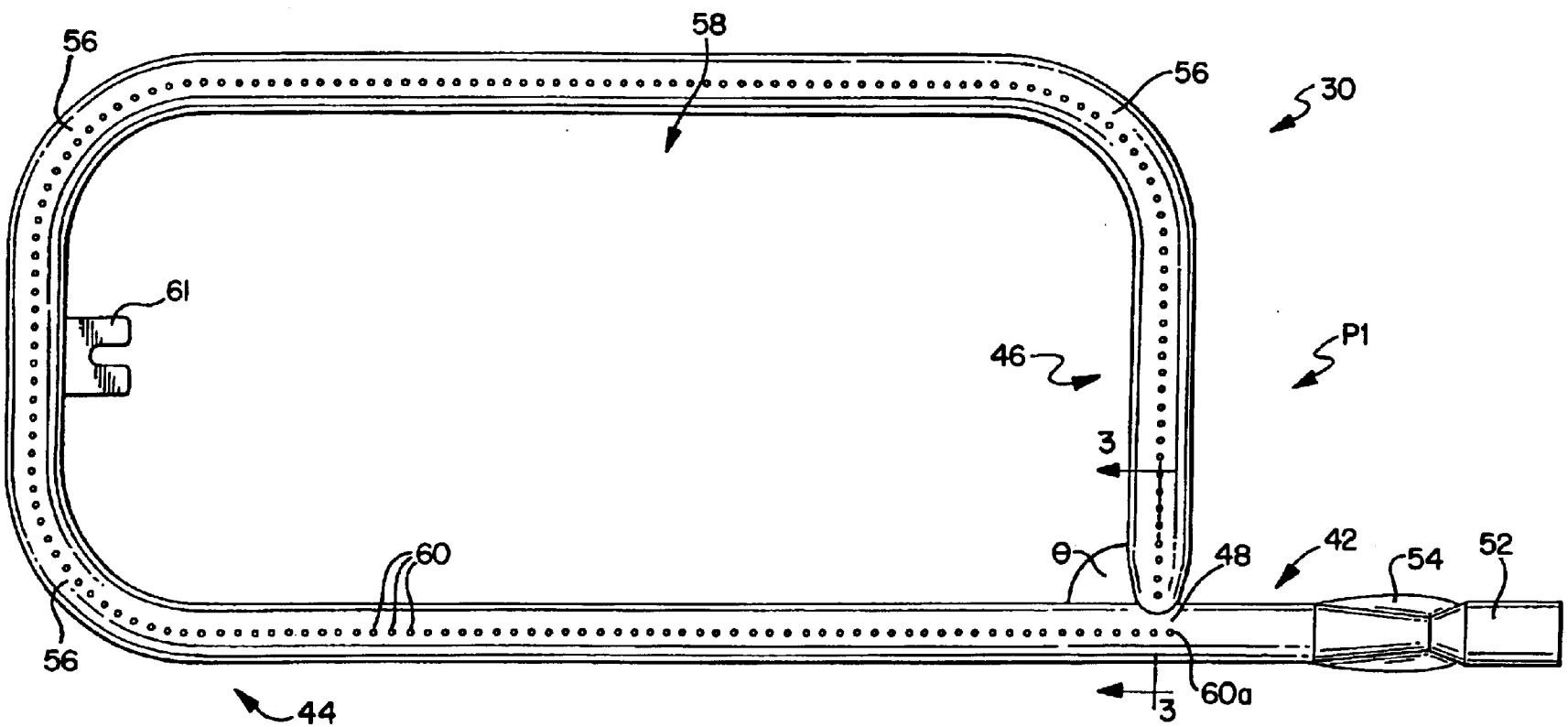
FIG. 2 is a top plan view of the first burner tube of FIG. 1.

Referring to FIG. 2, the burner tube 30 has a curvilinear configuration with proximal segment 42, a curvilinear distal segment 44, and a terminal end 46. The proximal segment 42 is adapted to be connected to a fuel source, i.e., a fuel tank. The distal segment 44 is downstream of the proximal segment 42, meaning that fuel flows from the proximal segment 42 to the distal segment 44. Unlike conventional burner tubes, the terminal end 46 connects to, or mates with the burner tube 30 at a union or interface region 48 of the proximal segment 42. Thus, the union region 48 is a junction zone between the terminal end 46 and the proximal segment 42. The connection between the terminal end 46 and the union region 48 forms a continuous burner tube or burner loop 30 wherein fuel flows in two distinct paths—through the distal segment 44 and through the terminal end 46. Described in a different manner, the terminal end 46 is in fluid communication with the proximal segment 42 at the union region 48 forming a multi-directional passageway that permits the flow of fuel between the proximal segment 42 and the terminal end 46. Described in yet another manner, the connection between the terminal end 46 and the union region 48 forms a control volume with multi-directional paths for the flow of fuel. Although shown as having a "P-shaped" or "D-shaped" configuration, the configuration and dimensions of the burner tube 30 can vary. For example, the burner tube 30 can have a round, square, or elliptical configuration.

As shown in FIG. 1, the burner tube 30 is positioned within the firebox 18 such that a portion of the proximal segment 42 extends through an aperture 34 in the second wall 27 of the firebox 18. Consequently, the distal segment 44 of the burner tube 30 is cooperatively positioned with the first wall 26 of the firebox 18. An inlet port 52 and a venturi element 54 of the proximal segment 42 are positioned beyond the firebox 18, and the inlet port 52 is connected to the fuel source. A control valve can be employed to regulate the supply of fuel from the fuel source. Accordingly, fuel from the fuel source passes through the proximal segment 42 and downstream to the distal segment 44 and the terminal end 46. Since the inlet port 52 is connected to the fuel source, no manifold is required for operation of the burner tube 30.

The distal segment 44 has at least one curvilinear portion 56, which contributes to the generally obround or rectangular configuration of the burner tube 30. As shown in FIG. 2, the distal segment 44 has three curvilinear portions 56, however, the precise number of such portions varies with the overall configuration of the burner tube 30. For example, the burner tube 30 can have an oval or elliptical configuration in which there would be a single, generally continuous curvilinear portion 56. In addition, the degree or amount of curvature varies with the overall configuration of the burner tube 30. The curvilinear portion 56 facilitates the connection of the terminal end 46 with the union region 48. Due to the mating of the terminal end 46 with the proximal segment 42, the burner tube 30 defines an enclosed central region 58. Although shown as having a generally obround or rectangular configuration, the central region 58 can have a round, square, or elliptical configuration.

The burner tube 30 has a plurality of outlet ports or apertures 60 from which a flame extends. Due to its multi-directional configuration, the continuous burner tube 30 forms an enlarged burner flame area compared to a conventional linear burner. The ignitor 38 (see FIG. 1) is used to ignite the fuel that has flowed through the through the burner tube 30 and exited the ports 60. As shown in FIG. 2, the outlet ports 60 are linearly aligned along the burner tube 30 to discharge fuel in a substantially vertical direction, meaning perpendicular to the plane of the burner tube 30. As a result, the outlet ports 60 are positioned in an upper portion of the burner tube 30 such that the resulting flame is directed towards the grate 32. Preferably, the outlet ports 60 are positioned at an upper portion of the burner tube 30 when viewed in cross section. Alternatively, the ports 60 are positioned in a side portion of the burner tube 30. Preferably, the outlet ports 60 are positioned throughout the burner tube 30, including the union region 48. The first or initial outlet port 60*a* is spaced a distance from the venturi element 54. Due to its multi-directional configuration, the continuous burner tube 30 forms an enlarged flame area, which is the sum of flames extending the outlet ports 60, that is consistent with the interior geometry of the firebox 18.

The distal segment 44 includes a bracket 61, that in combination with the aperture 50 in the proximal wall 26 of the firebox 18, supports the burner tube 30 within the firebox 18. A ramp or ledge (not shown) of the first wall 26 includes a fastener (not shown) that is cooperatively positioned for engagement with the bracket 61. The bracket 61 and the aperture 50 combine to support the burner tube 30 in an elevated position with respect to the bottom wall of the firebox 18. Preferably, the bracket 61 is welded to the burner tube 30.

Figure 3:
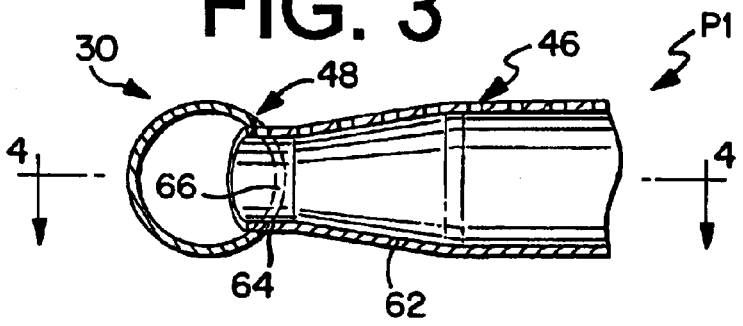
FIG. 3 is a partial cross-section of the first burner tube taken along line 3—3 of FIG. 2, showing a first connection between a terminal end and a union region.
Figure 4:
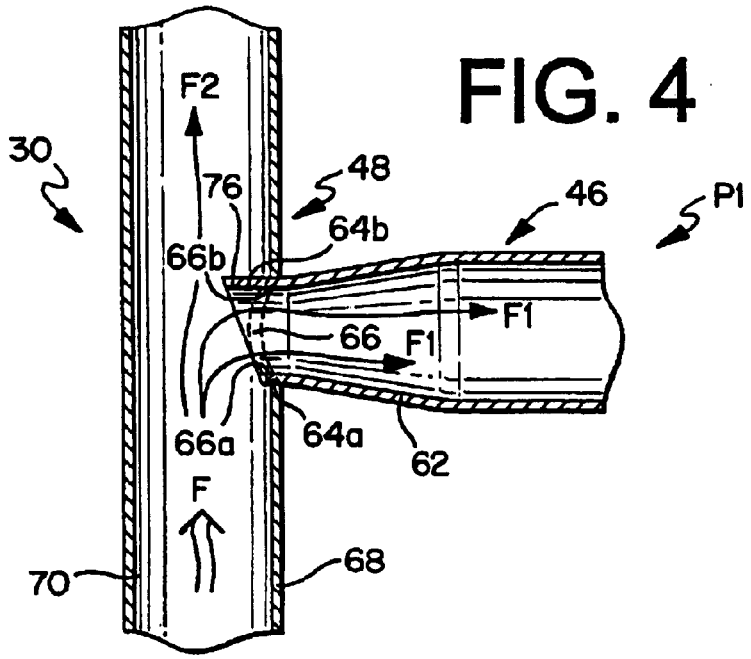
FIG. 4 is a partial cross-section of the first burner tube taken along line 4—4 of FIG. 3.

Referring to FIGS. 3 and 4, the terminal end 46 is in fluid connection with the union region 48 thereby forming the continuous burner tube 30. Due to the fluid connection, the burner tube 30 has a multi-directional passageway for the continuous flow of fuel. This structural aspect of the burner tube 30 provides multi-directional fuel flow through the tube 30. The connection between the terminal end 46 and the union region 48 is facilitated by the curvilinear portion 56. The terminal end 46 has a necked portion 62 with a tapered diameter that ceases at a mating portion 64. Accordingly, the diameter of the mating portion is less than the diameter of the necked portion 62. The mating portion 64 is either partially or entirely received by an aperture 66 in the union region 48. Once received by the aperture 66, the terminal end 46 is in fluid communication with the union region 48 of the proximal segment 42. The fluid communication between the union region 48 and the mating portion 64 defines a loop or passageway for fuel to flow throughout the burner tube 30.

To ensure the fluid communication, the diameter of the aperture 66 is equivalent to the diameter of the mating portion 64. Preferably, the diameter of the aperture 66 and the mating portion 64 is less than the diameter of the burner tube 30 at the union region 48. As shown in FIGS. 3 and 4, the aperture 66 and the mating portion 64 have a circular configuration when viewed in cross-section. Alternatively, the aperture 66 and the mating portion 64 can have an oval or elliptical configuration. A force can be applied to the terminal end 46 to deform it radially inward such that the mating portion 64 has an oval or elliptical configuration.

As shown in FIG. 2, the terminal end 46 is connected to the union region 48 at a connection angle θ, defined as the angle between the union region 48 and the terminal end 46. Although shown as approximately 90 degrees, the connection angle θ varies between 10 to 90 degrees along with the design parameters of the burner tube 30. The configuration of the burner tube 30 will be altered as the connection angle θ is varied. For example, when the connection angle θ is between 30–60 degrees the burner tube 30 has a "V-shaped" junction between the union region 48 and the terminal end 46. In addition, the geometry of the aperture 66 will vary with the connection angle θ. Where the connection angle θ is approximately 90 degrees, the aperture 66 will have a circular configuration. Where the connection angle θ is less than 90 degrees, the aperture 66 will have an elliptical configuration.

As shown in FIG. 4, the burner tube 30 has a first wall 68 and a second wall 70. Preferably, the aperture 66 is formed in the first wall 68 and has an leading edge 66*a* and a trailing edge 66*b*. The mating portion 64 has a leading edge wall 64*a* and a trailing edge wall 64*b*. The leading edge wall 64*a* extends past the leading edge 66*a* of the aperture 66 and into the union region 48, and the trailing edge wall 64*b* extends past the trailing edge 66*b* of the aperture 66 and into the union region 48. Preferably, the trailing edge wall 64*b* extends further into the internal area of the union region 48 than the leading edge wall 64*a*. As a result, the mating portion 64 has an angled or flared tip 76. The degree or amount that the trailing edge wall 64*b* extends past the trailing edge 66*b* of the aperture 66 varies with the design parameters of the burner tube 30. As discussed below, the geometry of the mating portion 64 and/or tip 76 can affect the flow of the fuel through the burner tube 30.

Referring to FIGS. 2–4, the burner tube 30 is in a first position P1 wherein the terminal end 46 is connected to the union region 48. Due to the curvilinear configuration of the distal segment 44, the terminal end 46 is biased towards the union region 48. This biasing causes the terminal end 46 to be lockingly engaged to, or secured with the union region 48 in the first position P1. Consequently, a fastening member or weldment is not required to maintain the connection between the terminal end 46 and the union region 48. In a second position P2, the terminal end 46 is unconnected or disengaged from the union region 48 and due to the biasing described above, a portion of the terminal end 46 extends past the union region 48. Described in a different manner, a portion of the terminal end 46 extends past the first wall 68 and/or the second wall 70 of the burner tube 30. Described in yet another manner, a portion of the terminal end 46 extends past a longitudinal axis of the union region 48. Also, in the second position P2, the terminal end 46 is vertically misaligned with a plane defined by the burner tube 30. Described in a different manner, the terminal end 46 passes either above or below the plane defined by the burner tube 30. The second position P2 generally represents an unassembled status of the burner tube 30. To move the burner tube 30 from the second position P2 to the first position P1, the biasing resulting from the curvilinear configuration must be overcome. First, a sufficient amount of force must be applied to the terminal end 46 such that it retracts and clears the first wall 68. Once this force is applied, a second force must be applied to the terminal end 46 to align it with the aperture 66. Once aligned with the aperture 66, the biasing of the burner tube 30 will cause the terminal end 46 to lockingly engage the union region 48.

In the first position P1, fuel flows from the fuel source in an initial flow path F through the proximal segment 42 and into the union region 48. Flow separation occurs generally within the union region 48. As indicated by the streamlines in FIG. 4, a first fuel portion, as indicated by second flow path F2, flows past the union region 48 and downstream to the distal region 44. Because the terminal end 46 is in fluid communication with the union region 48, a second fuel portion, as indicated by first flow path F1, flows past the union region 48 and downstream into the terminal end 46. Described in different terms, the flow path F of the fuel begins to diverge at the union region 48, with the second flow path F2 flowing through the distal region 44 and the first flow path F1 flowing through the terminal end 46. Since the terminal end 46 is in fluid communication with the proximal segment 42 in the first position P1, the fuel can flow in one of two distinct paths—downstream into the distal region 44 or downstream into the terminal end 46. In the second position P2, there is no connection between the terminal end 46 and the union region 48 and as a result, the first flow path F1 will not flow into the terminal end 46 from the union region 48.

Figure 5:
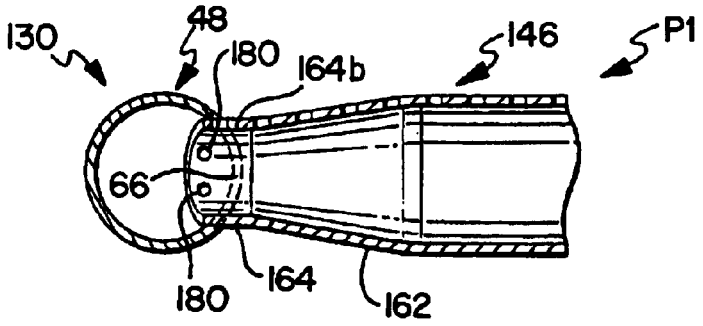
FIG. 5 is a partial cross-section of the first burner tube taken along line 3—3 of FIG. 2, showing a second connection between the terminal end and the union region.

In another preferred embodiment shown in FIG. 5, the terminal end 146 has a mating portion 164 with at least one opening 180. The opening 180 is adapted to permit an amount of the second flow path F2 to flow past the union region 48 and downstream to the proximal segment 42. Preferably, the opening 180 is positioned in a trailing wall 164*b* of the mating portion 164. The precise amount of the second flow path F2 that passes through the opening 180 depends upon a number of factors, including but not limited to the degree of insertion of the mating portion 164 in the union region 148, the configuration of the opening 180, and the flow rate of the fuel from the fuel source.

Figure 6:
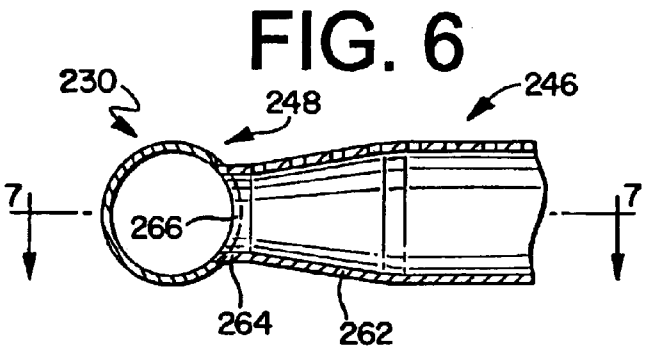
FIG. 6 is a partial cross-section of the first burner tube taken along line 3—3 of FIG. 2, showing a third connection between the terminal end and the union region.
Figure 7:
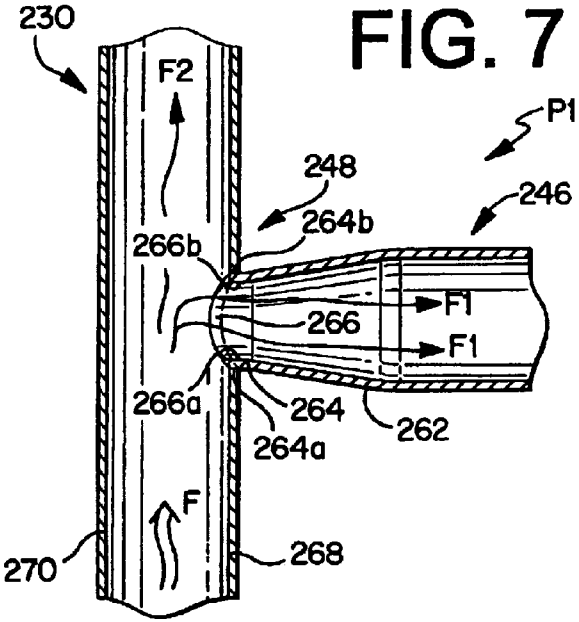
FIG. 7 is a partial cross-section of the first burner tube taken along line 7—7 of FIG. 6.

In another preferred embodiment shown in FIGS. 6 and 7, the terminal end 246 has a necked portion 262 with a tapered diameter that terminates in a mating portion 264. The terminal end 246 is connected to the aperture 266 of the union region 248. Referring to FIG. 7, a leading edge wall 264*a* of the mating portion 264 is positioned coincident with a leading edge 266*a* of the aperture 266. A trailing edge wall 264*b* of the mating portion 264 is positioned coincident with a trailing edge 266*b* of the aperture 266. Accordingly, the mating portion 264 does not extend past the aperture or into the union region 248. Preferably, the mating portion 264 is coped to fit against the first wall 268 of the burner tube 230.

In the first position P1, the terminal end 246 is in fluid communication with the union region 248. Due to the curvilinear configuration of the burner tube 230, the terminal end 230 is biased towards the union region 248. Accordingly, the mating portion 264 is lockingly engaged or secured to the union region 248 without the use of a fastener or weldment. In the first position P1, as indicated by the streamline F, fuel flows from the fuel source through the proximal segment 242 of the burner tube 230 and into the union region 248. As explained above, a second flow path F2 flows past the union region 248 and downstream to the distal region (not shown) of the burner tube 230. Because the terminal end 246 is in fluid communication with the union region 248, a first flow path F1 flows past the union region 248 and downstream into the terminal end 246. Described in different terms, the flow of fuel F begins to diverge at the union region 248, with the second flow path F2 flowing to the distal region and the first flow path F1 flowing through the terminal end 246.

Figure 8:
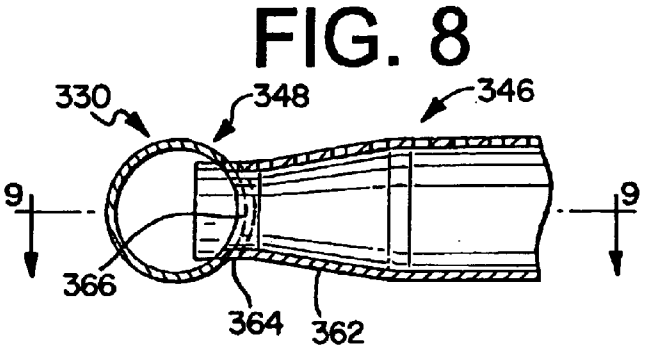
FIG. 8 is a partial cross-section of the first burner tube taken along line 3—3 of FIG. 2, showing a fourth connection between the terminal end and the union region.
Figure 9:
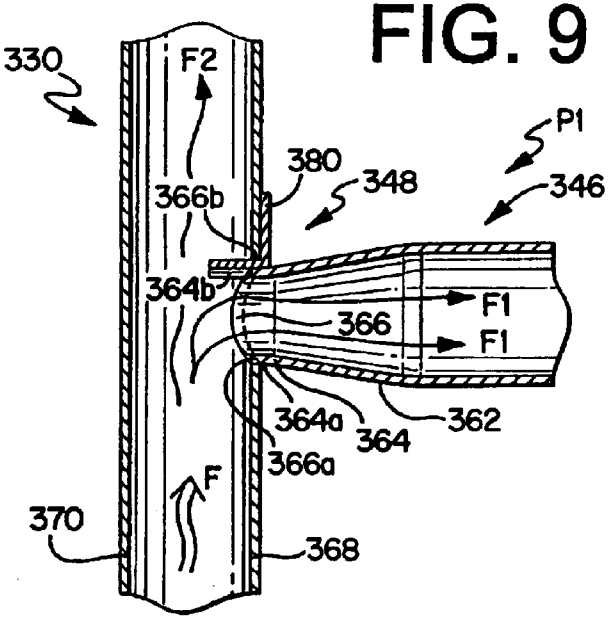
FIG. 9 is a partial cross-section of the first burner tube taken along line 9—9 of FIG. 8.

In another preferred embodiment shown in FIGS. 8 and 9, the terminal end 346 has a necked portion 362 with a tapered diameter that terminates in a mating portion 364. The terminal end 346 is connected to the aperture 366 of the union region 348. Referring to FIG. 9, a leading edge wall 364*a* of the mating portion 364 is positioned coincident with a leading edge 366*a* of the aperture 366. A trailing edge wall 364*b* of the mating portion 364 extends past a trailing edge 366*b* of the aperture 366 and into the union region 348. An insertion element 380 is positioned between the trailing edge 366*b* of the aperture 366 and the trailing edge 364*b* of the mating portion 364. The insertion element 380 is an "L-shaped" structure that is adapted to alter the fluid flow in the union region 348. The insertion element 380 is affixed to a first wall 368 of the burner tube 330 such that a portion of the insertion element 380 extends into the aperture 366. The degree or amount that the insertion element 380 extends into the aperture 366 varies with the design parameters of the element 380 and the burner tube 330.

In the first position PI, the terminal end 346 is in fluid communication with the union region 348. Due to the curvilinear configuration of the burner tube 330, the terminal end 330 is biased towards the union region 348. Accordingly, the mating portion 364 is lockingly engaged or secured to the union region 348 without the use of a fastener or weldment. In the first position P1, as indicated by the streamline F, fuel flows from the fuel source through the proximal segment 342 of the burner tube 330 and into the union region 348. As explained above, a second flow path F2 flows past the union region 348 and downstream to the distal region (not shown) of the burner tube 330. Because the terminal end 346 is in fluid communication with the union region 348, a first flow path F1 flows past the union region 348 and downstream into the terminal end 346. Described in different terms, the flow of fuel begins to diverge at the union region 348, with the second flow path F2 flowing to the distal region and the first flow path F1 flowing through the terminal end 346. The geometry of the insertion element 380 causes a flow disturbance in the union region 348 which alters the flow of the first and second flow paths F1, F2. Compared to the embodiment shown in FIGS. 7 and 8, the insertion element 380 increases the quantity of fuel flowing through the terminal end 346.

Figure 10:
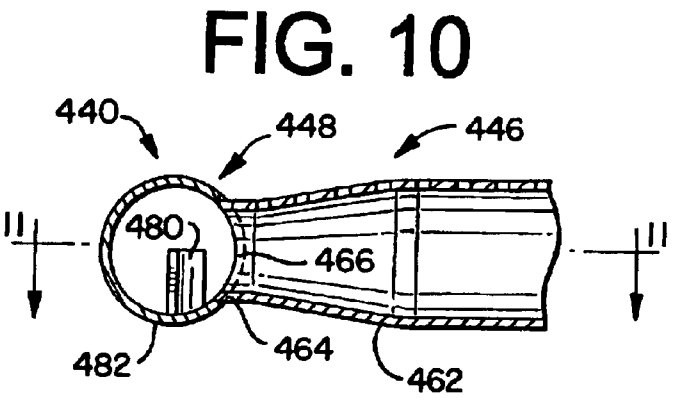
FIG. 10 is a partial cross-section of the first burner tube taken along line 3—3 of FIG. 2, showing a fifth connection between the terminal end and the union region.
Figure 11:
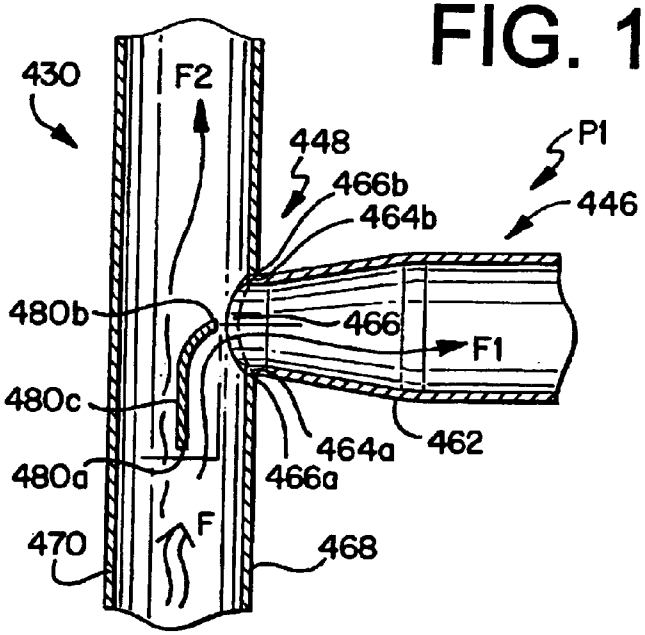
FIG. 11 is a partial cross-section of the first burner tube taken along line 11—11 of FIG. 10.

In another preferred embodiment shown in FIGS. 10 and 11, the terminal end 446 has a necked portion 462 with a tapered diameter that terminates in a mating portion 464. The terminal end 446 is connected to the aperture 466 of the union region 448. Referring to FIG. 11, a leading edge wall 464*a* of the mating portion 464 is positioned coincident with a leading edge 466*a* of the aperture 466. A trailing edge wall 464*b* of the mating portion 464 is positioned coincident with a trailing edge 466*b* of the aperture 466. Accordingly, the mating portion 464 does not extend past the aperture or into the union region 548. Preferably, the mating portion 564 is coped to fit against the first wall 568 of the burner tube 530. A vane 580 is positioned within the burner tube 530, preferably in the union region 548. The vane 580 is a curvilinear structure adapted to alter the fuel flow in the union region 548. The vane 580 is affixed to a lower portion 582 of the burner tube 530 and extends upward from the lower portion 582. The vane 580 has a leading edge 580*a* and a trailing edge 580*b*. As shown in FIG. 11, the leading edge 580*a* is positioned in the union region 548 upstream of the aperture 566 and the trailing edge 580*b* is positioned at a midpoint of the aperture 566. However, the precise location of the vane 580 within the union region 548 can vary. Referring to FIG. 10, the height of the vane 580 is approximately one-half of the diameter of the burner tube 530. However, the height of the vane 480 can vary such that the vane 480 occupies a greater or lesser amount of the union region 448.

In the first position P1, fuel F flows from the fuel source through the proximal segment 442 of the burner tube 430 and into the union region 448. Flow separation occurs at the leading edge 480*a* of the vane 480, where the leading edge 480*a* is the separation point. As indicated by the streamlines of FIG. 11, the initial flow path F is separated into two distinct flow paths F1, F2. The second flow path F2 flows along and past an outer surface 480*c* of the vane 480 and downstream to the distal region (not shown) of the burner tube 430. Because the terminal end 446 is in fluid communication with the union region 448, the first flow path F1 flows along and past an inner surface of the vane 480 and downstream into the terminal end 446. Described in different terms, the vane 480 causes a flow disturbance in the union region 448 which alters the initial flow path F into the first and second flow paths F1, F2, with the second flow path F2 flowing to the distal region and the first flow path F1 flowing through the terminal end 446.

Figure 12:
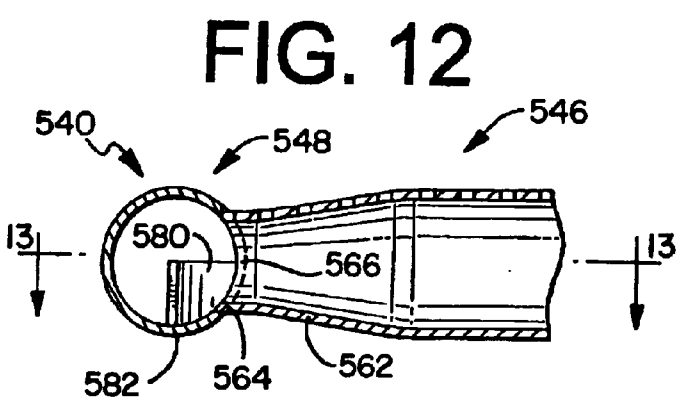
FIG. 12 is a partial cross-section of the first burner tube taken along line 3—3 of FIG. 2, showing a sixth connection between the terminal end and the union region.
Figure 13:
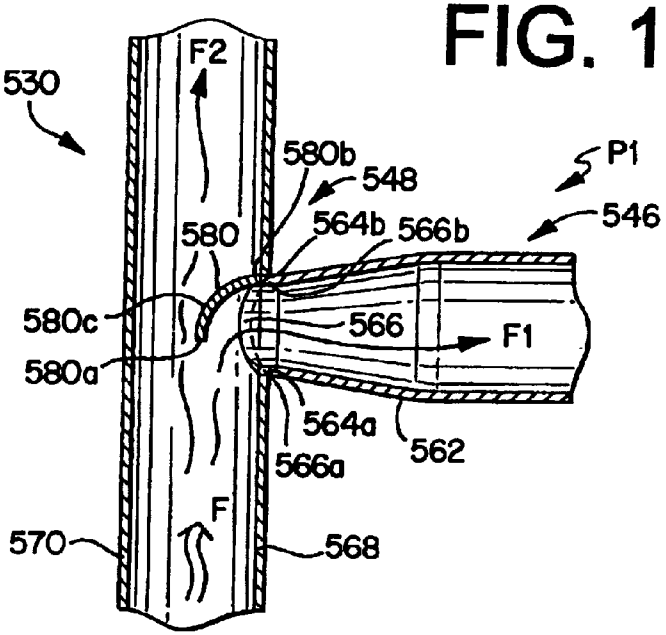
FIG. 13 is a partial cross-section of the first burner tube taken along line 13—13 of FIG. 12.

In another preferred embodiment shown in FIGS. 12 and 13, a curvilinear vane 580 is positioned within the burner tube 530, preferably in the union region 548. The vane 580 is a curvilinear structure adapted to alter the fuel flow in the union region 548. The vane 580 has a leading edge 580*a* and a trailing edge 580*b*. As shown in FIG. 13, the leading edge 580*a* is positioned in the union region 548 downstream of the leading edge 566*a* of the aperture 566. The trailing edge 580*b* is positioned adjacent the trailing edge 566*b* of the aperture 566. Referring to FIG. 12, the height of the vane 580 is approximately one-half of the diameter of the burner tube 530. However, the height of the vane 580 can vary such that the vane 580 occupies a greater or lesser amount of the union region 548.

In the first position P1, fuel F flows from the fuel source through the proximal segment 542 of the burner tube 530 and into the union region 548. Flow separation occurs at the leading edge 580*a* of the vane 580, where the leading edge 580*a* is the separation point. As indicated by the streamlines of FIG. 13, the initial flow path F is separated into two distinct flow paths F1, F2. The second flow path F2 flows along and past an outer surface 580*c* of the vane 580 and downstream to the distal region (not shown) of the burner tube 530. Because the terminal end 546 is in fluid communication with the union region 548, the first path F1 flows along and past an inner surface of the vane 580 and downstream into the terminal end 546. Described in different terms, the vane 580 causes a flow disturbance in the union region 548 which alters the initial flow path F into the first and second flow paths F1, F2, with the second flow path F2 flowing to the distal region and the first flow path F1 flowing through the terminal end 546.

Figure 14:
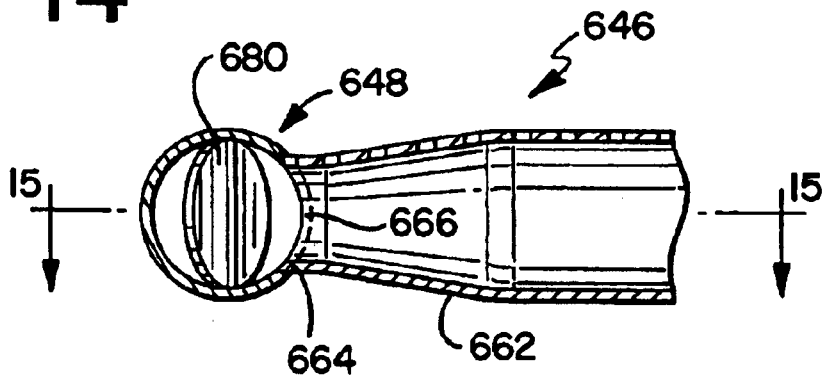
FIG. 14 is a partial cross-section of the first burner tube taken along line 3—3 of FIG. 2, showing a seventh connection between the terminal end and the union region.
Figure 15:
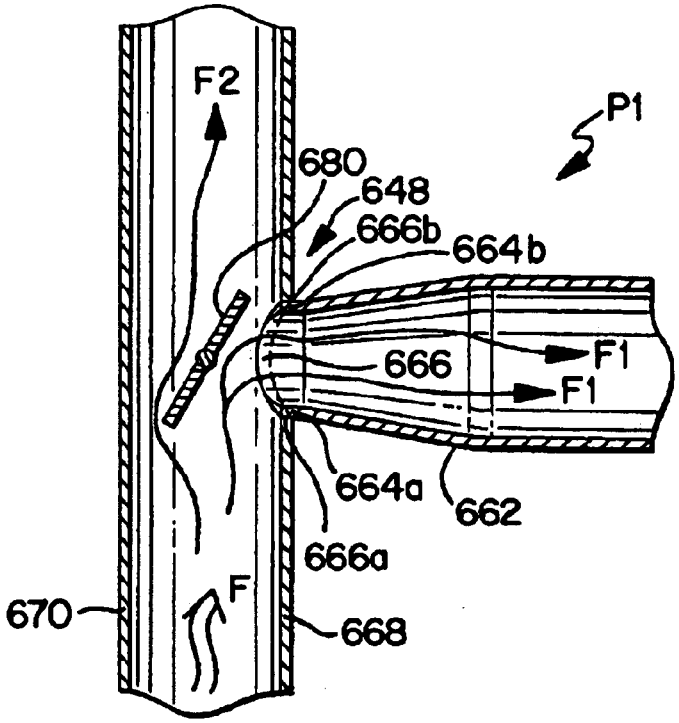
FIG. 15 is a partial cross-section of the first burner tube taken along line 15—15 of FIG. 14; and, FIG. 16 is a top plan view of a second burner tube of the invention.

In another preferred embodiment shown in FIGS. 14 and 15, a valve 680 is positioned within the burner tube 630, preferably in the union region 648. The valve 680 is moveable between a closed position wherein fuel F is prevented from flowing past the union region 648, and an open position wherein fuel F is able to flow past the union region 648. Preferably, the valve 680 is spring-loaded such that the valve 680 is in the closed position when fuel F is not flowing to the burner tube 630. Once fuel F is supplied to the burner tube 630, the valve 680 moves to the open position, thereby allowing fuel F to flow past the union region 748 and downstream to the distal region and the terminal end 646. The precise position of the valve 680, meaning degree of opening, can vary with the spring constant used in the valve 680.

In the first position P1 and when the valve 680 is in the open position, fuel F flows from the fuel source through the proximal segment 642 of the burner tube 630 and into the union region 648. As indicated by the streamlines of FIG. 15, the initial flow path F is separated into two distinct flow paths F1, F2. The second flow path F2 flows around the valve 680, including the leading and trailing edges 680*a,b* of the valve 680, and downstream to the distal region (not shown) of the burner tube 630. Because the terminal end 646 is in fluid communication with the union region 648, the first flow path F1 flows downstream into the terminal end 646. Described in different terms, the valve 680 causes a flow disturbance in the union region 648 which alters the initial flow path F into the first and second flow paths F1, F2, with the second flow path F2 flowing to the distal region and the first flow path F1 flowing through the terminal end 646.

Figure 16:
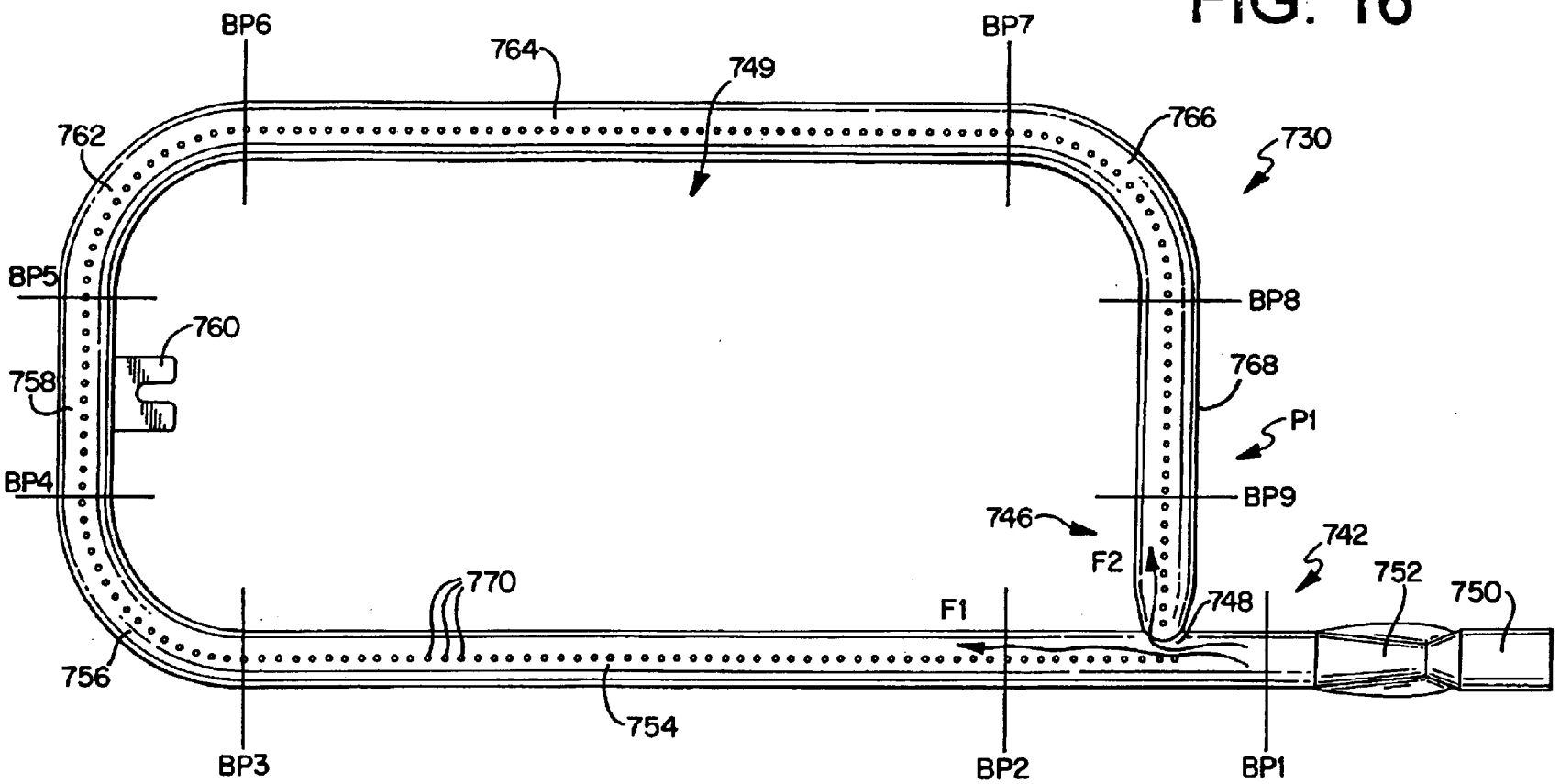

In another preferred embodiment shown in FIG. 16, the burner tube 730 generally comprises a first end 742 and a second end 746 in fluid connection to a union region 748. The fluid connection between the second end 746 and the union region 748 forms the continuous burner tube or burner loop 730. Thus, the union region 748 defines an interface zone between the second end 746 and the burner tube 730. Described in a different manner, the union region 748 is a junction zone between the second end 746 and the burner tube 730. Due to the connection between the second end 746 and the union region 748, the burner tube 730 defines an enclosed central region 749. The first end 742 has an inlet port 750 that is adapted to be connected to a control valve of a fuel source, i.e., a fuel tank. In this manner, the first end 742 is adapted to facilitate the transfer of fuel from the fuel source to the burner tube 730. A venturi element 752 is positioned adjacent the inlet port 750.

The union region 748 is a generally linear segment that is downstream from the first end 742. The union region 748 is bounded by the first burner position BP1 and the second burner position BP2. Adjacent to the union region 748 is the first linear segment 754, which is bounded by the second burner position BP2 and the third burner position BP3. A first curvilinear segment or elbow 756 is adjacent to the first linear segment 754. The first curvilinear segment 756 is bounded by the third burner position BP3 and the fourth burner position BP4. Adjacent to the first curvilinear segment 756 is a first transition segment 758, which is bounded by the fourth burner position BP4 and the fifth burner position BP5. The first transition segment 758 includes a bracket 760 adapted to support the burner tube 730 within the firebox 18. Preferably, the bracket 760 is welded to the burner tube 730.

A second curvilinear segment 762 is adjacent to the first transition segment 758. The second curvilinear segment 762 is bounded by the fifth burner position BP5 and the sixth burner position BP6. Adjacent to the second curvilinear segment 762 is a second linear segment 764, which is bounded by the sixth burner position BP6 and the seventh burner position BP7. A third curvilinear segment 766 is adjacent to the second linear segment 764. The third curvilinear segment 766 is bounded by the seventh burner position BP7 and the eighth burner position BP8. Adjacent to the third curvilinear segment 766 is a second transition segment 768, which is bounded by the eighth burner position BP8 and the ninth burner position BP9. The second end 746 is adjacent to the second transition segment 768 and is bounded by the ninth burner position BP9 and the union region 748. A plurality of outlet ports 770 are spaced along the burner tube 730. As shown in FIG. 6, the outlet ports 770 begin in the union region 748 and continue downstream throughout the burner tube 730. The radius of curvature of the curvilinear segments 756, 762, 766 can vary with the design parameters of the burner tube 730; however, the curvilinear segments 756, 762, 766 must be configured to permit the second end 746 to be in fluid communication with the union region 748.

Because the second end 746 is connected to the union region 748 to form a continuous burner tube 730, fuel from the fuel source can flow in two distinct paths. These flow paths result from the second end 746 being in fluid communication with the union region 748. In contrast, conventional burners have a single flow path which begins at the inlet and continues through the burner to the terminal end, which is closed or crimped. As shown in FIG. 16, a first fuel portion, as indicated by flow path F1, flows past the union region 748 and downstream to the first linear segment 754. An amount of this first flow path F1 exits the ports 770 in the first linear segment 754, while a remaining quantity flows downstream to the first curvilinear segment 756. An amount of this remaining first flow path F1 exits the ports 770 in the first curvilinear segment 756 and a remaining quantity flows downstream to the first transition segment 758. An amount of this remaining first flow path F1 exits the ports 770 in the first transition segment 758 and a remaining quantity flows downstream to the second curvilinear segment 762. An amount of this remaining first flow path F1 exits the ports 770 in the second curvilinear segment 762 and a remaining quantity flows downstream to the second linear segment 764. This flow path continues until all of the first flow path F1 exits the ports 266.

The second fuel portion, as indicated by flow path F2, flows past the union region 748 and downstream into the second end 746. An amount of the second flow path F2 exits the ports 770 in the second end 746 and a remaining quantity flows downstream to the second transition segment 768. An amount of this remaining second flow path F2 exits the ports 770 in the second transition segment 768 and a remaining quantity flows downstream to the third curvilinear segment 766. An amount of this remaining second flow path F2 exits the ports 770 in the third curvilinear segment 766 and a remaining quantity flows downstream to the second linear segment 764. This flow path continues until a portion of the first flow path F1 converges and/or mixes with a portion of the second flow path F2. For example, the remnants of the first flow path F1 can combine with the remnants of the second flow path F2 within the third curvilinear segment 766. The point at which the first and second flow paths F1, F2 converge depends upon a number of factors, including but not limited to the flow rate of the fuel and the configuration and dimensions of the burner tube 730.

In another preferred embodiment (not shown), the continuous burner tube has a generally "B-shaped" configuration. The burner tube has a lengthened proximal segment which accommodates the connection of a primary burner tube and a secondary burner tube. Consistent with the above disclosure, the distal end of the primary burner tube is in fluid communication with a first union region of the proximal segment. The secondary tube is generally "C-shaped" with a first and a second end. The first end of the secondary tube is in fluid communication with a second union region, and the second end of the secondary tube is in fluid communication with a third union region.

Due to the three junctions at the union regions, the B-shaped burner tube has multi-directional passageways. Accordingly, fuel from the fuel source can flow in multiple directions throughout the continuous burner tube and as a result, the flame area emanating from the burner tube is increased.

The present invention provides a novel method for distributing fuel through a continuous burner tube. Referring to FIG. 2, the proximal segment 42 is connected to a fuel source. Fuel enters the burner tube 30 at the inlet port 52. A regulator (not shown) is utilized between the fuel source and the proximal segment 42 to regulate and/or modulate the flow of fuel. Preferably, a manifold is not required. The fuel forms an initial flow path F and flows downstream through the venturi element 54 and into the union region 48 of the proximal segment. As shown in FIGS. 4, 8, and 10 and due to the fluid connection between the union region 48 and the terminal end 46, separation of the initial flow path F occurs in the union region 48 with the formation of a first flow path F1 and a second flow path F2. The first flow path F1 flows past the union region 48 and downstream to the distal region 44. The second flow path F2 flows past the union region 48 and downstream to the terminal end 46. As a result, two distinct flow paths F1, F2 are formed to distribute fuel throughout the burner tube 30. Fuel from each flow path F1, F2 is combusted upon exiting the outlet ports 60. The burner tube 30 has a burner flame area, which is the collective measure of the flames exiting the plurality of outlet ports 60. Due to the multi-directional configuration of the continuous burner tube 30, the flame area is enlarged to match the geometry of the firebox 18, thereby increasing the efficiency and effectiveness of the burner tube 30.

Preferably, at some point downstream of the union region 48, the first and second flow paths F1, F2 converge. The precise location of the convergence depends upon a number of factors, including but not limited to the flow rate of the fuel and the configuration of the burner tube 30.

The burner tube of the present invention provides a number of significant advantages over conventional burners. First, the connection between the terminal end and the union region forms a continuous burner tube having a multi-directional passageway for the flow of fuel. This allows for multiple flow paths of fuel throughout the burner tube, which in turn increases fuel distribution throughout the burner tube. Also, the burner tube has only one inlet valve, which permits a direct connection to the fuel source without the need of a manifold. This reduces the material costs and eases the assembly of the grill assembly having the burner tube. In addition, the continuous burner tube forms an enlarged flame area with a geometry that is similar to the interior geometry of the firebox resulting in uniform heat distribution to the grate positioned in the firebox. This reduces the need for multiple burner tubes in the firebox. Third, due to the curvilinear segments and the resulting biasing, the terminal end is connected to the union region without the use of a fastener. This reduces the assembly process and as a result, the material and labor costs are reduced.

Another benefit of the present invention relates to shipping and packaging concerns of the burner tube and the barbecue grill assembly. Unlike conventional burners, the burner tube of the present invention is easily and fully assembled by connecting the terminal end to the union region. Consequently, the burner tube can be packaged and shipped fully assembled generally eliminating further assembly by the end user or the retailer.

While the specific embodiments have been illustrated and described, numerous modifications come to mind without significantly departing from the spirit of the invention and the scope of protection is only limited by the scope of the accompanying claims.

We claim:

1. A burner for a barbecue grill comprising:

a continuous curvilinear burner having a proximal segment, a distal segment, and, a terminal end with a mating portion connected to an aperture of a union region of the proximal segment to form a multi-directional passageway, wherein the mating portion has a reduced diameter to mate with the aperture.

2. The burner of claim 1 wherein the connection between the terminal end and the union region forms a continuous burner wherein the proximal segment, the distal segment, and the terminal end are in fluid communication.

3. The burner of claim 1 wherein the distal segment has at least one curvilinear portion adapted to direct the terminal end substantially transverse to the proximal segment.

4. The burner of claim 1 wherein a generally rectangular central region is defined by the connection between the terminal end and the union region.

5. The burner of claim 1 wherein the proximal segment is adapted to be connected to a fuel source such that a portion of fuel from the fuel source flows from the proximal segment downstream through the terminal end in a continuous path.

6. The burner of claim 1 further comprising a plurality of outlet ports positioned throughout the burner.

7. A burner assembly for use with a cooking chamber, the burner assembly comprising:

a fuel source;

a burner tube having a proximal segment connected to the fuel source, the proximal segment having a union region, the union region having an aperture; a distal segment; a plurality of outlet ports; and, a terminal end with a mating portion in fluid communication with an aperture of the union region, the mating portion having a reduced outer diameter to mate with the aperture.

8. The burner assembly of claim 7 wherein the connection between the terminal end and the aperture forms a continuous burner tube.

9. The burner assembly of claim 8 wherein a first portion of fuel from the fuel source flows through the union region and downstream to the distal segment.

10. The burner assembly of claim 9 wherein a second portion of fuel from the fuel source flows through the union region and downstream to the terminal end.

11. The burner assembly of claim 7 wherein an initial flow of fuel diverges in the union region into a first flow path and a second flow path, the first flow path flowing downstream through the distal segment and the second flow path flowing downstream through the terminal end.

12. The burner assembly of claim 7 wherein the distal segment has at least one curvilinear portion.

13. The burner assembly of claim 7 wherein the burner tube defines an enclosed central region, the central region having a generally rectangular configuration.

14. The burner assembly of claim 7 wherein the terminal end is coped to match an outer wall of the union region.

15. A burner assembly for use with a barbecue grill, the burner assembly comprising:

a fuel source;

a burner tube having a proximal segment connected to the fuel source, the proximal segment having a linear union region with an aperture, the burner tube further having a distal segment, a plurality of outlet ports, and a terminal end with a mating portion removably connected to the union region at the aperture, the mating portion is cooperatively dimensioned with an outer wall of the union region wherein the mating portion has a reduced diameter compared to the diameter of the terminal end.

16. The burner assembly of claim 15 wherein the terminal end is biased into connection with the union region at the aperture.

17. The burner assembly of claim 15 wherein the terminal end is biased towards the proximal segment.

18. The burner assembly of claim 15 wherein the terminal end is coped to match an outer wall of the union region about the aperture.

19. The burner assembly of claim 15 wherein the distal segment has at least one curvilinear portion.

20. A burner assembly for use with a barbecue grill, the burner assembly in fluid communication with a fuel source comprising:

a burner tube having a proximal segment connected to the fuel source, the proximal segment having a union region with an aperture, the burner tube further having a distal segment, a plurality of outlet ports, and a terminal end with a mating portion removably connected to the union region at the aperture, wherein the mating portion has a reduced diameter compared to the diameter of the terminal end to mate with the aperture.

* * * * *